United States Patent [19]

Finney

[11] 4,055,051

[45] Oct. 25, 1977

[54] UNITARY DRILL BIT AND ROOF BOLT

[75] Inventor: James Lee Finney, Cranbury, N.J.

[73] Assignee: The United States of America as represented by the Secretary of the Interior, Washington, D.C.

[21] Appl. No.: 647,522

[22] Filed: Jan. 8, 1976

[51] Int. Cl.[2] ..... E21D 21/00; E21D 20/02

[52] U.S. Cl. ..... 61/45 B; 175/315; 175/226

[58] Field of Search ..... 61/45 B, 39, 63; 85/51, 85/64; 52/155; 175/226, 315

[56] References Cited

U.S. PATENT DOCUMENTS

| | | | |
|---|---|---|---|
| 1,288,973 | 12/1918 | Osborn | 85/51 |
| 3,115,056 | 12/1963 | Teeple, Jr. | 61/45 B |
| 3,279,301 | 10/1966 | Fischer | 61/45 B |
| 3,283,513 | 11/1966 | Kierans et al. | 61/45 B |
| 3,298,144 | 1/1967 | Fischer | 61/45 B |
| 3,311,012 | 3/1967 | Williams | 61/45 B |
| 3,815,368 | 6/1974 | Turzillo | 61/53.52 |
| 3,899,893 | 8/1975 | Banerjee et al. | 61/45 B |

FOREIGN PATENT DOCUMENTS

| | | | |
|---|---|---|---|
| 49,426 | 9/1930 | Norway | 85/51 |
| 790,483 | 2/1958 | United Kingdom | 61/45 B |

*Primary Examiner*—Paul R. Gilliam
*Assistant Examiner*—Alex Grosz
*Attorney, Agent, or Firm*—Thomas Zack; Donald A. Gardiner

[57] ABSTRACT

A combined drill bit and roof bolt and a method for forming a bore hole in a mine roof and for reinforcing same. The drill bit and roof bolt form the same structural element which preferably comprises an elongate hollow tube. On one end of the tube is formed a multi-bladed bit. The diameter of the hole cut by the blades is somewhat larger than the diameter of the elongate tube. Formed intermediate the blades on the bit head are a plurality of apertures. The apertures perform the dual function of providing an exit passageway for rock chips as the drilling proceeds, as well as providing a means through which a quick-setting adhesive resin is extruded from inside the hollow bolt to the newly drilled annular hole extending thereabout. The extrusion is accomplished by means of a pig element forced up the tube.

In a preferred embodiment, the pig element is formed by a wedge-type top anchor which thereafter drives a split shell positioned therearound in order to tension the bolt prior to the hardening of the adhesive resin.

19 Claims, 10 Drawing Figures

UNITARY DRILL BIT AND ROOF BOLT

BACKGROUND OF THE INVENTION

1. Field of the Invention

The present invention is related generally to a method and apparatus for reinforcing roofs in subterranean excavations such as mines, subway tunnels, and the like, and more particularly, is directed towards a combination drill bit and roof bolt utilized in a bore hold formation and roof reinforcement technique.

2. Description of the Prior Art

There are many different apparatus and techniques utilized for strengthening roofs in subterranean structures such as coal mines, subway tunnels, or the like. The techniques in general use require a drill or bore hole to be formed in the roof structure as a separate and distinct step from installing the strengthening member.

In one such technique, the bore hole is adpated to house mechanical expansion gripping members to permit a bolt to be tightened down against a face of the rock structure to therefore reinforce same.

Another widely used technique involves the insertion of a rod or bolt within the drill hole and the subsequent placement of an adhesive or grouting material thereabout while the bolt is tensioned. The inner or embedded end of the rod or bolt is securely anchored at the end of the hole. Typically, this is done with an expansion shell anchor or by cementing in the embedded end prior to tensioning. The outer end of the rod or bolt may be provided with threads, a nut, and a face-plate washer. The nut is tightened-down to pull up the plate against the front face of the structure in order to tension the rod. The tensioning is applied prior to and maintained during the hardening of the adhesive.

As noted above, in either of the well-known techniques, as exemplified for example in U.S. Pat. Nos. 3,877,235 and 3,695,045, a bore hole must be drilled to accommodate the roof bolt. The actual drilling of the hole and subsequent insertion of the bolt, tensioning, and application of grouting is, of course, automated to every extent possible in order to expedite each installation cycle and thereby save valuable time.

However, it may be appreciated that at least two different types of tools must be utilized during each such installation cycle; namely, a high-speed drill for forming the bore hole, and a bolter for insertion and tensioning of the roof bolt. This handling of many tools necessarily takes time.

Another handling factor to consider is the frequency with which the drill bits utilized to form the bore holes must be changed. Due to the highly abrasive nature of the rock structures, and the ease with which the sharpened blades wear down, they must frequently be replaced, which requires yet another handling step that interrupts the cycle. Also, deleterious effects may result from using a dull drill bit which, perhaps due to economics or inadvertence, has not been replaced.

OBJECTS AND SUMMARY OF THE INVENTION

It is therefore a primary object of the present invention to provide a combination drill bit-roof bolt which obviates the necessity of having to utilize several different tools during the drilling of a bore hole and the installation and tensioning of a roof bolt.

Another object of the present invention is to provide a technique for drilling a bore hole and for installing and tensioning a roof bolt which simplifies previous methods and steamlines the entire process which results in considerable time savings.

An additional object of the present invention is to provide a combination drill bit-roof bolt which obviates the necessity for re-sharpening dull bits.

A still further object of the present invention is to provide a drill bit and roof bolt which are unitary in structure and which are therefore cheap, easy to manufacture, and highly reliable structurally.

Another object of the present invention is to provide a combination roof bolt-drill bit by means of which a mined roof structure may be strengthened in a most expeditious and simple manner, either by utilizing a grouted strengthening member, or by utilizing a grouted prestressed member.

The foregoing and other objects are attained in accordance with one aspect of the present invention through the provision of a unitary roof bolt and drill bit for forming a bore hole in a mine roof and for subsequent permanent mounting therein in order to strengthen the roof. The unitary bit-bolt comprises a rigid tubular elongated body, a drill bit formed at one end of the tubular body for drilling the bore hole, and a bearing plate formed at the outer end of the tube which covers the opening of the hole after the tubular body is adhesively secured. The bit head, which preferably comprises a multi-bladed drag bit, forms a bore hole somewhat larger than the diameter of the tubular body. The drill bit is left in place, after the hole is formed, so as to form an annulus thereabout which is filled with an adhesive. Within the tubular body is positioned a sack or bag which contains a quick-setting resin adhesive and associated hardener-catalyst. The bag or sack of adhesive is initially placed to one side of the interior of the tubular body in order to provide a passageway alongside the sack by means of which rock chips generated during the drilling operation may pass. Apertures are formed on the bit head through which the adhesive may be later extruded by means of a piston element.

In accordance with other aspects of the present invention, the tubular body may be stressed and anchored prior to the curing of the adhesive by an anchor assembly positioned internally of the tubular body. The anchor assembly is configured to serve as the piston element to extrude the adhesive. One form of the anchor assembly includes a cone member which threadingly engages a threaded end of a bolt rod whose distal end extends beyond the bearing plate of the unit. An expansible shell is disposed between the cone member and the wall of the tubular body. In response to the rotation of the bolt rod, the shell expands against the walls of the tubular body in order to anchor the embedded end of the bolt and prevent the release of longitudinal tension introduced into the bit-bolt through an axial compression force applied to the bolt rod.

In accordance with still further aspects of the present invention, a method is provided for reinforcing a mine roof which comprises the steps of drilling a bore hole in the mine roof with a hollow roof bolt, leaving the roof bolt in place within the bore hole once formed, and extruding adhesive from within the bolt through apertures formed therein so as to substantially fill the bore hole around the bolt. The technique further includes the step of tensioning the roof bolt prior to curing of the adhesive, and the step of preplacing the adhesive-containing bag or sack within the hollow bolt so as to leave a roof chip passageway along the length. The extruding step is performed by a pig element driven longitudinally through the inner portion of the bolt which eventually ruptures the bag.

BRIEF DESCRIPTION OF THE DRAWINGS

Other objects, aspects, uses and advantages of the present invention will be more fully appreciated as the same becomes better understood when considered in connection with the following detailed description of the present invention when viewed in conjunction with the accompanying drawings, in which:

FIG. 1 through 3 sequentially illustrate a preferred technique for drilling a bore hole and inserting and tensioning a roof bolt in accordance with a preferred embodiment of the present invention, wherein FIG. 1 shows the preferred embodiment roof bolt-drill bit just prior to the drilling step, FIG. 2 illustrates the unitary bit-bolt just after completion of the drilling step and at the beginning of the extrusion step, while FIG. 3 illustrates the completion of the extrusion step and the application of a tensioning force during the last phase of the inventive technique;

FIGS. 4 through 6 illustrate an alternative technique with regards to the insertion and tensioning steps of the inventive method, wherein FIG. 4 illustrates the bit-bolt inserted in place, FIG. 5 illustrates the alternative pig element-anchor assembly at the initiation of the extrusion step, and FIG. 6 illustrates the final position of the bit-bolt in accordance with this alternative embodiment;

DETAILED DESCRIPTION OF THE PREFERRED EMBODIMENT

Figure 1:
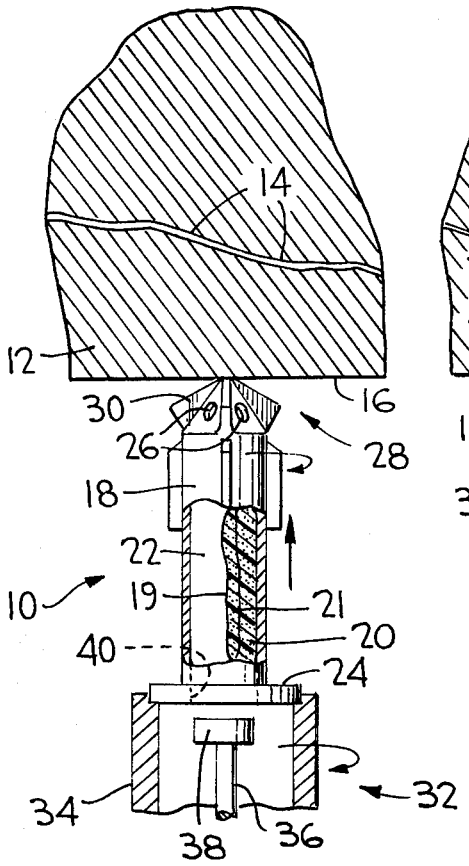
Figure 2:
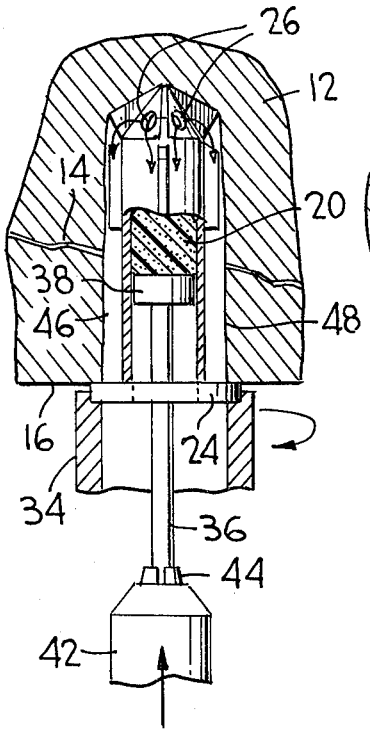
Figure 3:
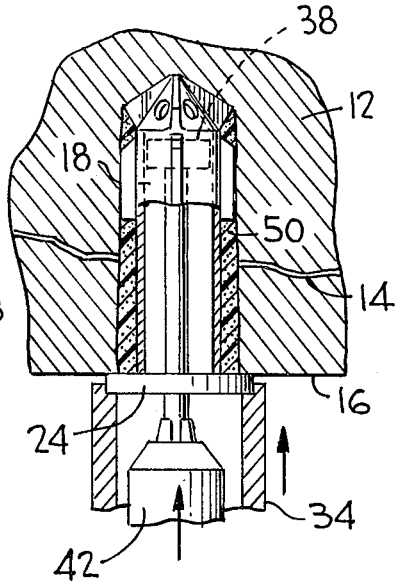

Referring first to FIGS. 1 through 3, they illustrate in sequence the novel technique according to the present invention which incorporates a unique drill bit-roof bolt assembly indicated generally by the reference numeral 10. Bit-bolt 10 is intended to be drilled into a rock-like wall or other support structure which is to be secured together or reinforced. Typically, wall 12 may have a fault, such as at 14, running therethrough.

Figure 9:
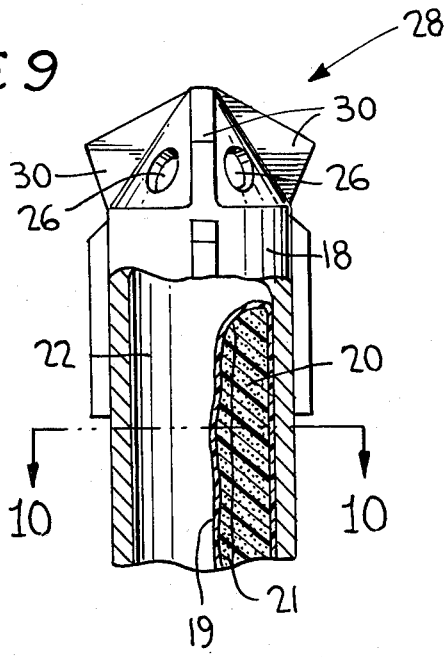
FIG. 9 is an enlarged side view, partially in section, illustrating the construction details of the preferred embodiment drill bit-roof bolt combination in accordance with the present invention.
Figure 10:
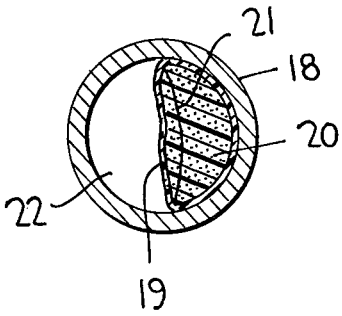
FIG. 10 is a cross-section of the preferred embodiment bit-bolt of FIG. 9 taken along line 10—10 thereof.

Bit-bolt 10, illustrated in somewhat more detail in FIGS. 9 and 10, comprises an elongated tubular member 18 which encloses a hollow cylindrical structure. Within tubular wall 18 is placed a bag, sack, capsule or cartridge 19 which encloses a main body of resin material 20 and a segregated supplemental body of a catalyst, curing or hardening resin 21. Both resins are retained within bag 19 by means of a relatively thin wall of any suitable type that may be easily ruptured or broken in a manner to be described in more detail hereinafter. The resin material 21 is utilized for polymerizing, curing and setting the main body of resin material 20 when they are mixed together and displaced along the bore hole to be formed about the bolt.

Integrally formed at one end of tubular body or member 18 of bolt 10 is a drill bit indicated generally at 28. Bit 28 preferably comprises a plurality of blades 30 disposed thereabout. The bit configuration illustrated as the preferred embodiment is known in the art as a drag bit, which comprises a folded head design in which two, three, or four bladed versions may be utilized. It should be noted that the overall span of blades 30 exceeds the diameter of tubular member 18 such that the hole formed by the bit 28 will provide an annular hole about the tubular portion 18 of bolt 10.

Disposed intermediate blade members 30 are a plurality of apertures 26 which provide a dual function. First, apertures 26 serve as chip receiving holes through which pieces or chips of the rock roof structure pass as the hole is being drilled. It should be noted that resin bag or capsule 19 is initially lodged and preferably secured along one side of tubular member 18 in order to provide an open passageway 22 for the drilled chips to exit the hollow bolt 10.

The second function of apertures 26, to be described in more detail hereinafter, is that of providing resinextruding passageways for allowing the adhesive 20 and its catalyst 21 to be extruded to surround bolt 18. Although the number of apertures is not critical, enough should be supplied, preferably in a periodic fashion about the periphery of bit 28, in order to provide an even and steady flow therethrough of both chips and, in the later step, adhesive.

Referring back to FIG. 1, the provision of drag bit 28 on the extended end of tubular wall member 18 allows the bit-bolt 10 of the present invention to be driven by a conventional rotary bolter, indicated generally in FIG. 1 by the reference numeral 32. Bolter 32 comprises a cylindrical structure 34 for supporting a bearing plate 24. Bearing plate 24 is integral with or secured at the outer end of tubular member 18 and is provided for enclosing the bore hole to be drilled and to serve as a load-bearing shoulder for washers, roof header blocks, etc., as the support application may require. Bolter 32 also includes a rod 36, the end of which terminates in a piston element 38. Plate 24 is also provided wtih an aperture 40 sized to permit piston 38 to pass therethrough.

Referring now to FIG. 2, a drill chuck 42 having fingers 44 for gripping rod 36 is illustrated. In the phase of the operation illustrated in FIG. 2, the bore hole has been formed by the action of rotary bolter 32 and bit-bolt 10. The blade-to-blade diameter of drag bit 28 has resulted in an annular space 46 formed between the wall 48 of the hole and the tubular wall 18 of bit-bolt 10. In the particular portion of the operation illustrated, piston 38 is being pushed upwardly, the sack 19 has been ruptured by compression against the interior walls of tubular member 18, and the adhesive-catalyst mixture is being extruded through apertures 26 of drag bit 28, as illustrated schematically by the arrows extending therefrom. The bit-bolt 10 continues its rotary motion in order to fully mix the adhesive and catalyst.

Depicted in FIG. 3 is the final state of the bit-bolt 10 fully lodged within the bore hole. The adhesive mixture 50 fully encompasses tubular member 18, having been fully extruded from apertures 26 by the action of element 38.

In order to tension bolt 10, upward pressure is provided by means of chuck 42 and cylindrical sleeve 34. Upward force of chuck 42 forces element 38 against the rear wall of bolt 10 to tension same as a result of the firm placement of bearing plate 24 against the roof 16 of structure 12.

When the adhesive 50 is fully cured, bolter 32 is removed which results in an upward pressure by bearing plate 24 against the roof 16. Preferably, if a fault 14 is in the vicinity of the bore hole, some of the adhesive 50 finds its way therein to strengthen the grip. The plate 24, retains the adhesive in the hole.

Figure 4:
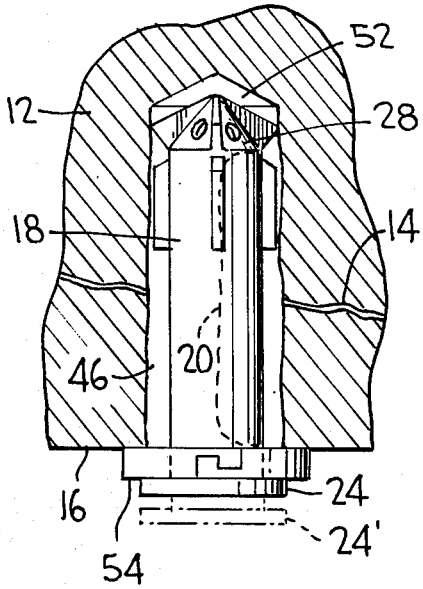
Figure 5:
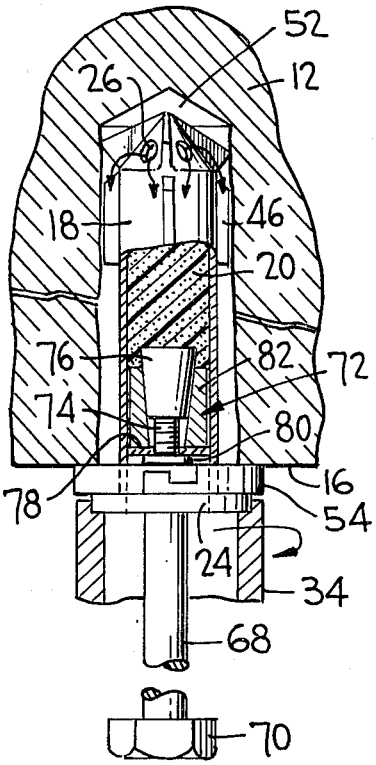
Figure 6:
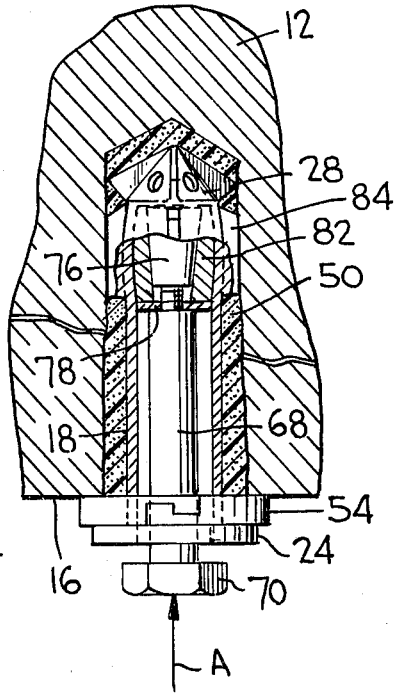

Referring now to FIGS. 4 through 6, while utilizing the same basic drill bit-roof bolt unitary assembly as described above, an alternative anchor tensioning means is illustrated. Referring first to FIG. 4, the bit-bolt 10 is illustrated as comprising the tubular member 18, the adhesive-catalyst sack or capsule 20 being shown in dotted outline. After the annular hole 46 is formed in roof structure 12 as in the first embodiment, tubular member 18 along with bearing plate 24 are withdrawn somewhat from the hole, such as to the position shown in dotted outline 24', in order that a split collar 54 may be inserted between plate 24 and roof 16 of structure 12. Collar 54 is split in order that it may be easily inserted over plate 24 and about tubular member 18 after the annular hole 46 has been drilled without requiring removal of tubular member 18.

Figure 7:
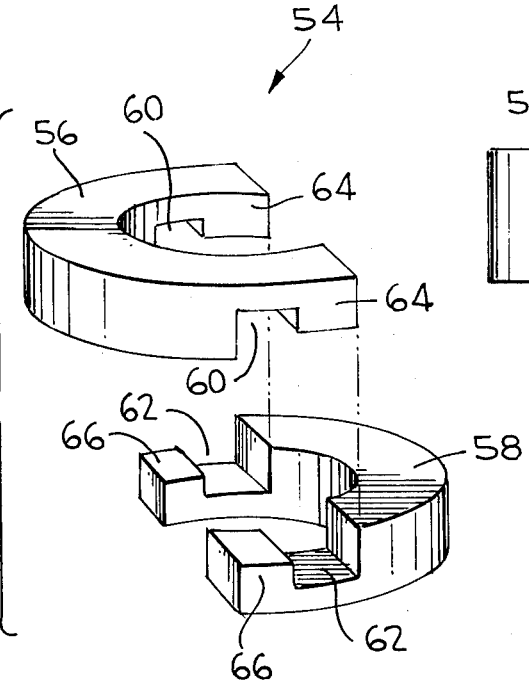
FIG. 7 is an exploded perspective view illustrating the components of a split collar assembly utilized in conjunction with the second embodiment of FIGS. 4 through 6.
Figure 8:
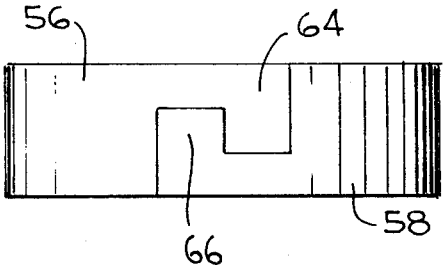
FIG. 8 is a side view of the components illustrated in FIG. 7 but in their joined state.

Split collar 54 is shown in somewhat more detail in FIGS. 7 and 8. Referring thereto, collar 54 comprises two substantially identical halves 56 and 58, each of which consists of a C-shaped member having complementary interfitting means. For example, member 56 has a pair of notches 60 formed therein and a pair of teeth 64 extending from the ends thereof. Similarly, C-shaped half 58 has a pair of notches 62 formed therein and a pair of teeth 66 extending therefrom. As seen in FIG. 8, teeth 64 and 66 respectively fit within complementary notches 62 and 60 of halves 58 and 56.

Referring back to FIG. 5, collar 54 is shown positioned between roof 16 and place 24, and an alternative pig-anchor device is indicated generally by the reference numeral 72. Anchor device 72 is formed on the end of a bolt rod 68, which outer end terminates in a hexagonal or square drive head 70. Extending upwardly from the end 80 of rod 68 is a threaded portion 74. Connected intermediate rod 68 and threaded portion 74 is a thrust plate 78 adapted to turn with head 70, bolt 68, and threads 74.

A cone or wedge member 76 has a threaded central opening extending through its length and is normally in threaded engagement with the threaded portion 74 of rod 68. An expansible shell 82 surrounds cone member 76, and is axially disposed between the cone 76 and thrust plate 78.

FIG. 5 illustrates a phase of the technique quite similar to that illustrated in FIG. 2 wherein the resin-hardener mixture is being extruded by cone or wedge member 76 (which serves as the piston element in this embodiment) through apertures 26 to fill the annular hole 46 surrounding tubular member 18.

Referring now to FIG. 6, rod 68 is shown fully inserted within tubular member 18 such that cone 76 has extruded all of the adhesive-catalyst through apertures 26 so as to fill the annular region 46 and the head region 52 of the hole. The anchor device or assembly 72 (cone 76 and shell 82) now bears against the bit end of the bit-bolt 10. An upward axial compression force (arrow A, FIG. 6) is now applied to the rod head 70 to induce tension in the tubular member 18. While this compression is being applied, the head 70 is rotated. This results in movement of the cone 76 towards the axially-fixed thrust plate 78, resulting, in turn, in the expansion of the shell 82 which forces the adjacent portion of the tubular member 18 into contact with the drilled hole wall. Frictional engagement between the rock and longitudinally extending fins 84 on the tubular member immediately anchors the bit-bolt in the hole and prevents the release of the longitudinal tension stresses induced in the tubular member. Obviously the application of a compression force to head 70 and the rotation of head 70 must occur prior to the final hardening of adhesive-catalyst mixture 50 about bolt 18.

It is seen that I have provided an extremely simple, yet novel, drill bit-roof bolt unit by means of which installation is simplified, money is saved on procedures, accuracy is improved in that a sharp bit may be used for each hole, and the desired adhesive is easily applicable about the inserted bolt. Further, means have been provided for utilizing a top anchor as piston element in another economical combinational feature of the present invention. The second embodiment allows the bit-bolt to be tensioned either by the anchor alone, or by pushing up on the roof as in the first embodiment.

Numerous variations of the present invention are possible in light of the above teachings. I therefore wish it to be understood that I do not wish to be limited to the exact details of construction shown and described, for obvious modifications will occur to a person skilled in the art.

I claim as my invention:

1. A unitary roof bolt and drill bit for forming a bore hole in a mine roof and for subsequent permanent mounting therein in order to strengthen same, which comprises:

a rigid tubular body, bit means formed at one end of said tubular body for drilling a bore hole in the mine roof, adhesive and hardener means, which, upon mixing, secure said tubular body within said bore hole, being integrally carried with and within said tubular body, aperture means on said tubular body for releasing said adhesive and hardener means into said borehole, and bearing plate means formed at the outer end of said tubular body, for substantially covering the opening of said hole when said tubular body is adhesively secured therein by said adhesive and hardener means, and bearing against said roof.

2. The unitary roof bolt and drill bit as set forth in claim 1 wherein said bit means includes blade means formed thereon for cutting said bore hole and said aperture means being positioned between said blade means for receiving roof chips resulting from the action of said blade cutting means.

3. The unitary roof bolt and drill bit as set forth in claim 2 wherein said adhesive and hardener means are disposed in a sack means positioned to one side within said tubular body so as to provide a pathway adjacent thereto for receiving said roof chips.

4. The unitary roof bolt and drill bit as set forth in claim 3 wherein said bit means comprises a drag bit and wherein said blade means comprise a plurality of blades which span a diameter larger than that of said tubular body and which are regularly disposed about said bit, said aperture means comprising holes formed in said bit between said blades.

5. The unitary roof bolt and drill bit as set forth in claim 4 wherein said bearing plate means includes an opening centrally formed therein for receiving a piston and rod assembly means for compressing said sack means to rupture against the inner surfaces of said bit means and said tubular body.

6. The unitary roof bolt and drill bit as set forth in claim 5 wherein said bit means includes aperture means formed therein through which said adhesive means and said hardener means are forcibly extruded by said piston and rod assembly means after the rupture of said sack means.

7. The unitary roof bolt and drill bit as set forth in claim 6 wherein said piston and rod assembly means includes anchor means for stressing said tubular body of said unitary roof bolt and drill bit prior to the setting of said adhesive means.

8. The unitary roof bolt and drill bit as set forth in claim 7 wherein said anchor means comprises a bolt rod having a threaded end and a driven end, a cone member in threaded engagement with said threaded end of said bolt rod, expansible shell means disposed between said cone member and the wall of said tubular body for expanding the same in response to the rotation of said driven end of said bolt rod and surface gripping means on said body adjacent said shell means to frictionally engage the wall of the hole as said body is expanded.

9. The unitary roof bolt and drill bit as set forth in claim 8 wherein said anchor means further comprises a thrust plate having a diameter substantially the same as the inner diameter of said tubular body and positioned about and attached to said bolt rod adjacent said expansible shell means for preventing downward movement thereof.

10. The unitary roof bolt and drill bit as set forth in claim 9 further comprising split collar means positioned between said mine roof and said bearing plate for preventing downward movement thereof.

11. The unitary roof bolt and drill bit as set forth in claim 10 wherein said split collar means comprises two substantially identical C-shaped washer members having interfitting teeth formed at the free ends thereof.

12. A method for reinforcing a mine roof, comprising the steps of:

disposing an adhesive means within a hollow roof bolt;

subsequently drilling a bore hole in the mine roof with said hollow roof bolt having said adhesive means disposed therein;

leaving the roof bolt in place within said bore hole once formed; and extruding said adhesive means from within said bolt through apertures formed therein to release said adhesive means so as to substantially fill said bore hole around said bolt.

13. The method as set forth in claim 12, further comprising the step of tensioning said roof bolt when positioned within said bore hole while said adhesive is allowed to harden thereabout.

14. The method as set forth in claim 13 wherein said tensioning step includes the step of expanding a shell means against the wall of said bolt by drawing a cone member therethrough.

15. The method as set forth in claim 14 wherein said shell driving step includes the step of turning a bolt rod which is threadingly engaged with said cone member so as to draw said cone member towards the head of said bolt rod.

16. The method as set forth in claim 13, wherein said drilling step includes the step of drilling a bore hole having a diameter somewhat larger than the diameter of said roof bolt.

17. The method as set forth in claim 13, further comprising the step of receiving the roof chips resulting from said drilling step in the inner portion of said roof bolt.

18. The method as set forth in claim 17, wherein said adhesive means is disposed in a bag which is placed within said roof bolt in such a manner so as to leave a through passageway theretonext for said roof chips to be received.

19. The method as set forth in claim 18, wherein said extruding step includes the steps of driving a piston element longitudinally through the inner portion of said roof bolt and of rupturing said bag by exerting pressure thereon against the inner walls of said bolt.

* * * * *